US008269626B2

(12) United States Patent
Gates

(10) Patent No.: US 8,269,626 B2
(45) **Date of Patent: *Sep. 18, 2012**

(54) PERIMETER ALARM MONITORING SYSTEM

(76) Inventor: Tell A. Gates, Falls Church, VA (US)

( * ) Notice: Subject to any disclaimer, the term of this patent is extended or adjusted under 35 U.S.C. 154(b) by 794 days.

This patent is subject to a terminal disclaimer.

(21) Appl. No.: 11/700,893

(22) Filed: Feb. 1, 2007

(65) Prior Publication Data

US 2008/0186171 A1 Aug. 7, 2008

(51) Int. Cl.
*G08B 13/00* (2006.01)

(52) U.S. Cl. ..... 340/541; 340/542; 340/545.1; 340/572.1

(58) Field of Classification Search ..... 340/545.1–547, 340/541, 549, 3.31, 542, 572.1
See application file for complete search history.

(56) References Cited

U.S. PATENT DOCUMENTS

| | | | | |
|---|---|---|---|---|
| 4,982,176 | A * | 1/1991 | Schwarz | 340/567 |
| 5,595,075 | A * | 1/1997 | Chen | 70/95 |
| 6,078,269 | A * | 6/2000 | Markwell et al. | 340/517 |
| 6,498,567 | B1 * | 12/2002 | Grefenstette et al. | 340/825.62 |
| 6,963,282 | B1 * | 11/2005 | Yeates et al. | 340/572.4 |
| 7,119,658 | B2 * | 10/2006 | Stilp | 340/5.61 |
| 7,355,515 | B2 * | 4/2008 | Lee et al. | 340/542 |
| 7,495,558 | B2 * | 2/2009 | Pope et al. | 340/572.1 |
| 2001/0024163 | A1 * | 9/2001 | Petite | 340/628 |
| 2003/0098791 | A1 * | 5/2003 | Carlson et al. | 340/547 |
| 2004/0212499 | A1 * | 10/2004 | Bohinc, Jr. | 340/539.29 |
| 2005/0225451 | A1 * | 10/2005 | Inui | 340/686.1 |
| 2007/0063833 | A1 * | 3/2007 | Kates | 340/521 |
| 2007/0075852 | A1 * | 4/2007 | Schmidt et al. | 340/500 |
| 2008/0186173 | A1 * | 8/2008 | Gates | 340/542 |

* cited by examiner

*Primary Examiner* — Brent Swarthout
(74) *Attorney, Agent, or Firm* — Dan Fiul

(57) ABSTRACT

A photoelectric cell powered based security system relies on a photoelectric cell powered detector to transmit security information to a main control panel. An optional extender relays security information between a local photoelectric cell powered detector and a main control panel in the event that the local photoelectric cell powered detector is unable to directly communicate with the main control panel.

23 Claims, 8 Drawing Sheets

PERIMETER ALARM MONITORING SYSTEM

BACKGROUND OF THE INVENTION

1. Field of the Invention

This invention relates generally to security systems. More particularly, it relates to a photoelectric cell powered security system.

2. Background

Security systems are becoming increasingly commonplace, especially within homes. In particular, security systems based on wired sensors and wireless sensors relying on batteries are used to detect intrusions within homes and businesses.

FIG. 6 shows a conventional wired security system 601 based on wired sensors throughout a home or business attached to a main control panel controlled by a remote user panel.

In particular, FIG. 6 shows a conventional wired security system 601 comprising a wired door sensor 610, a door 615, a wired window sensor 620, a window 625, a wired motion sensor 630, a wired main control panel 640, a wired remote user panel 640, a central monitoring station 650, and a speaker 670.

A conventional wired security system 601 is configured in a hub and spoke topology. The wired remote user panel 640 acts as a hub to all of the spokes within the system comprising the wired door sensor 610, the wired window sensor 620, the wired motion sensor 630 and the wired remote user panel 640.

The wired remote user panel 640 is used to activate and deactivate the conventional wired security system 601. Moreover, the wired remote user panel 640 provides visual indication of the status of the conventional wireless security system 601, such as activation status, individual zone status, etc.

The wired remote user panel 640 constantly monitors the output of: the wired door sensor 610, attached to door 615, the wired window sensor 620, attached to window 625, and the wired motion sensor 630. If any of the wired door sensor 610, the wired window sensor 620, and the wired motion sensor 630 detect an intrusion within an associated zone, the wired remote user panel 640 activates the speaker 670 to audibly alert occupants of a building being monitored by the wired remote user panel 640 of a possible intrusion.

The drawback of a conventional wired security system 601 is the need to pre-wire the system, i.e., during construction of a building or post-wire the system, i.e., after construction of a building. Post-wiring a conventional wired security system 601 potentially runs into such issues as access to open walls to run wires, less than optimal placement of sensors due to limitations created by installation issues, time, cost, the need to hire a professional installer, etc.

FIG. 7 shows a conventional wireless security system 701 based on wireless sensors throughout a premises wirelessly connected to a main control panel controlled by a remote user panel.

In particular, FIG. 7 shows a conventional wireless security system comprising a wireless door sensor 710, a door 715, a wireless window sensor 720, a window 725, a wireless motion sensor 730, a wireless remote user panel 750, a central monitoring station 755 and a speaker 770.

The wireless remote user panel 750, typically located near a doorway, is used to activate and deactivate the conventional wireless security system 701. Moreover, the wireless remote user panel 750 provides visual indication of the status of the conventional wireless security system 701, such as activation status, individual zone status, etc.

The main control panel 740 constantly monitors the output of: the wireless door sensor 710, attached to door 715, the wireless window sensor 720, attached to window 725, and the wireless motion sensor 730. If any of the wireless door sensor 710, the wireless window sensor 720 and the wireless motion sensor 730 detect an intrusion within an associated zone, the main control panel 740 activates the speaker 770 to audibly alert occupants of a building being monitored by the wireless remote user panel 750 of a possible intrusion, relays the alert to the wireless remote user panel 750 for display of the alert information, and alerts the optional central monitoring station 755.

The drawback of a conventional wireless security system 701 is the need to replace batteries within the system, i.e., a battery within the wireless door sensor 710, a battery within the wireless window sensor 720, a battery within the wireless motion sensor 730, and a possibly a battery within the wireless remote user panel 750. A dead battery within a large premises having a large number of wireless window sensors 720 and wireless motion sensors 730 can leave a significant portion of a building unprotected in the event of an intrusion. Even worse, a dead battery within the wireless remote user panel 750 completely disables the local reporting in the conventional wireless security system 701. Moreover, a dead battery within a large premises having a large number of windows can result in significant time and effort expended to periodically change out batteries, typically every two to three years to ensure all batteries within the system are powered.

As a result of the drawbacks cited above for both conventional wired 601 and wireless security systems 701, there is a need for apparatus and methods which allow security systems to be more easily installed than with a wired home security system and without a wireless security system's reliance on sensors powered by replacement batteries.

SUMMARY OF THE INVENTION

In accordance with the principles of the present invention, a security sensor is disclosed comprising a photoelectric cell to collect light energy and create electric power, a security switch and a wireless transmitter to wirelessly transmit sensor data associated with the security switch with the solar and/or artificial illumination power generated from the photoelectric cell.

In accordance with the principles of the present invention, a security system and method are disclosed that perform charging of a power source with photoelectric energy, formulating security sensor data and transmitting the security sensor data with power generated with the photoelectric or local light energy.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

The present invention provides a Light Powered Perimeter Alarm Monitoring System (LPPAM) that relies on photoelectric cell powered wireless security sensors to monitor for an intrusion within a home (e.g., door sensors and/or window sensors). In accordance with the principles of the present invention, an optional extender checks the status of LPPAM sensors and relays any possible intrusions to a main control user panel for activation of a user alert.

The LPPAM provides a system and method to monitor windows and doors without retrofitting a building's wiring. The LPPAM eliminates the requirement of maintenance of batteries, i.e., to regularly replace the batteries at each door and/or window sensor within the system.

With the LPPAM, only a small amount of energy storage is required in the unit because the local energy storage is constantly being charged during daylight hours or periods that a local illumination is available. As a result, the size of the door sensors and/or window sensors can be made extremely small. This allows the door sensors and window sensors to discreetly attached to the door or window or to be embedded in the window latch or the door lock, thereby improving the ease and aesthetics of the installation.

Figure 1:
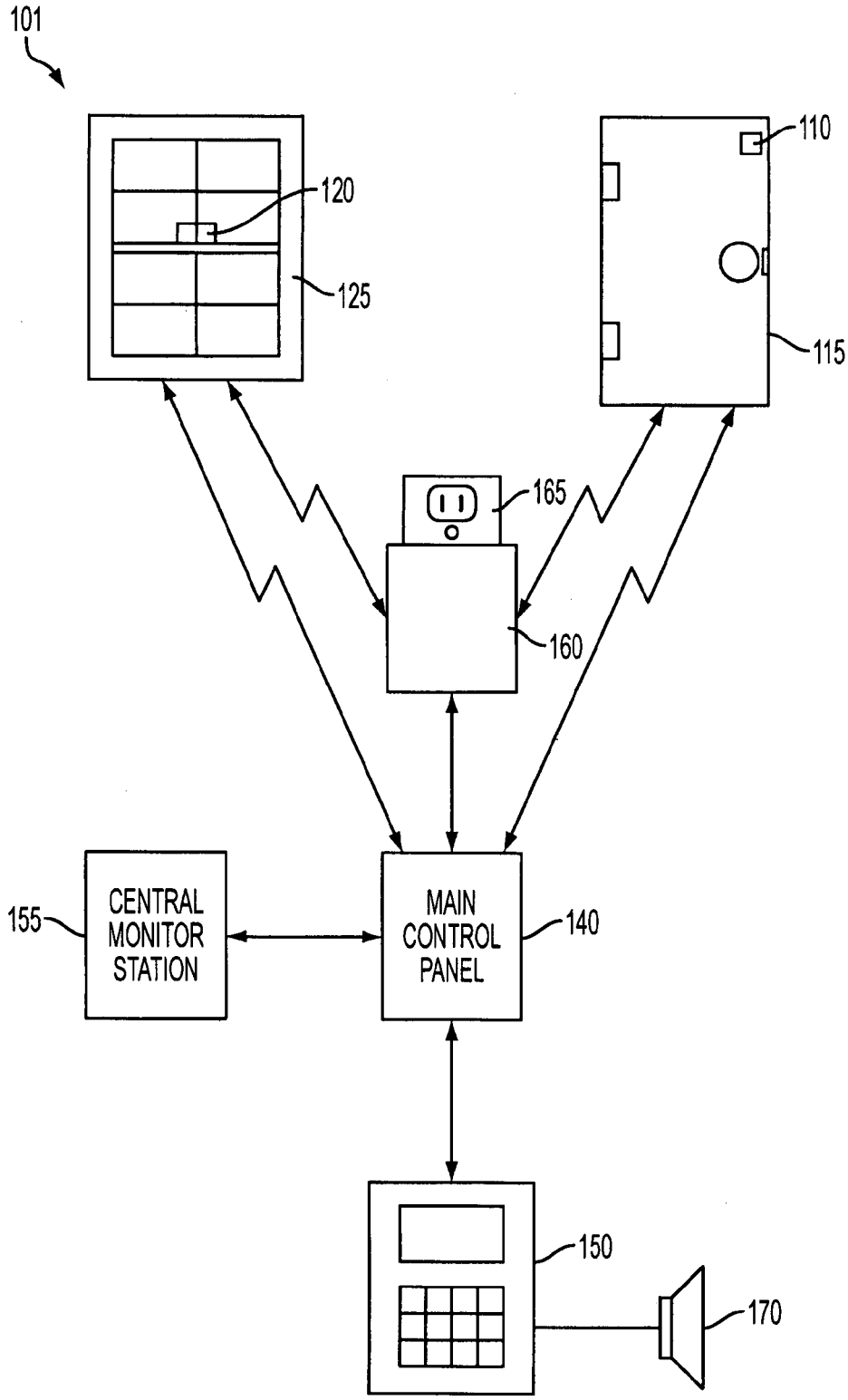
FIG. 1 shows an overview of a wireless home security system relying on light power, in accordance with the principles of the present invention.

FIG. 1 shows a system level view of the LPPAM 101, in accordance with the principles of the present invention.

In particular, as shown in FIG. 1, the LPPAM 101 is comprised of a wireless window sensor 120, a window 125, a wireless door sensor 110, a door 115, an optional wireless interface extender 160, a conventional wall outlet 165, a main control panel 140, a remote user panel 150, a central monitoring station 155 and a speaker 170.

A single wireless window sensor 120, a single wireless door sensor 110, a single wireless interface extender 160, and a single user panel 150 are show in FIG. 1 for simplification of illustration only. Within an actual implementation of the LPPAM 101 in accordance with the principles of the present invention, the number of wireless window sensors 120, wireless door sensors 110, wireless interface extender 160, main control panel 140, and user panels 150 is virtually unlimited, i.e., based on the size and configuration of the premises being monitored.

The wireless window sensor 120 is illustrated as being incorporated in a lock mechanism of window 125. To simplify incorporation of a wireless window sensor 120 into a window 125 at the time of manufacture and to retrofit a premises with a wireless window sensor 120 in accordance with the invention, the wireless window sensor 120 can be manufactured to fit within a conventional window lock housing. For retrofit, as well as new installations, this approach with current technology would allow a small, ~0.5" by 0.75" by ⅛" (or smaller) module to be developed to be innocuously placed on a window, in a window, door or lock mechanism to minimize aesthetic objections that exist with currently employed battery powered wireless window sensors.

Although not shown in FIG. 1, wireless door sensor 110 can be incorporated in a lock mechanism of door 115. A photoelectric cell is placed at any convenient place along the associated frame of the door 115 or integrated with the lock mechanism attached to door 115.

A spring loaded magnetic switch, a mechanical switch, or similar switch activates the wireless window sensor 120 to signal a possible intrusion within a premises being monitored by the LPPAM 101.

The wireless door sensor 110 is illustrated as being incorporated in a door 115. To sense an opening of door 115, a second portion of the wireless door sensor 110 is incorporated into a door frame, not shown. Although the wireless door sensor 110 can also be placed within a door frame, not shown, and a second portion can be incorporated into door 115. To simplify incorporation of a wireless door sensor 110 into a door 115 at the time of manufacture and to retrofit a premises with a wireless door sensor 110 in accordance with the invention, the wireless door sensor 110 can be manufactured to fit within a conventional door lock housing. A spring loaded magnetic switch, a mechanical switch, or similar switch embedded in the wireless door sensor 110 to signal a possible intrusion within a premises being monitored by the LPPAM 101.

Moreover, the wireless window sensor 120 and wireless door sensor 110 can be used to detect whether their respective associated window 125 and door 115 latch/lock mechanisms are locked/unlocked. A mechanical switch activates the wireless window sensor 120 and wireless door sensor 110 to signal if the associated window 125 and door 115 is locked/unlocked. In this manner, the LPPAM can be used to determine if windows and doors within a building being monitored are locked/unlocked in addition to monitoring if window 125 or door 115 is opened/closed.

The optional wireless interface extender 160 conveniently plugs into a conventional wall outlet 165 for power. The wireless interface extender 160 is optional because of the ability of the wireless window sensor 120 and the wireless door sensor 110 to communicate their respective intrusion status. If the distance between the wireless window sensor 120 and the wireless door sensor 110 is near enough to the main control panel 140 as to establish communications, the wireless interface extender 160 is not required for system functionality. However, a wireless interface extender 160 may be desirable in the event of a battery with the wireless window sensor 120 and the wireless door sensor 110 becomes weak and limits the communications distance from the wireless window sensor 120 and the wireless door sensor 110.

A periodic polling signal is emitted from the wireless interface extender 160 to communicate with the wireless window sensor 120 and the wireless door sensor 110. The value read from the wireless window sensor 120 and the wireless door sensor 110 is transmitted to the main control panel 140. Alternately, to conserve power the wireless window sensor 120 and the wireless door sensor 110 only send sensor data to the main user panel 140 upon a change in status of the wireless window sensor 120 and the wireless door sensor 110.

The main control panel 140 receives the sensor data transmitted from the wireless window sensor 120 and the wireless door sensor 110, and alternately from the wireless interface extender 160. The sensor data is checked for an unexpected opening or a non locked/latched condition at the time the premises in being secured. If the sensor data shows an unexpected opening of a window or door while the premises is secured, the speaker 170 is activated to alert a user of a potential intruder within a premises being monitored by the LPPAM 101. Optionally, the central monitoring center 155 is called through a telephone interface or wireless interface to alert local police of a possible intrusion. Such central monitoring service is an optional paid service that is not required to operate the LPPAM 101 as a deterrent to an intruder entering a premises with speaker 170 sounding an alarm.

The remote user panel 150 is used to activate and deactivate the LPPAM 101. Moreover, the user panel 150 provides visual indication of the status of the LPPAM 101, such as activation status, individual zone status, etc. The zone status information would be shown on the user panel 150 of the unlocked/unlatched conditions of the door sensor 110 and window sensor 120 at the time that the premises is being secured. If either the door sensor 110 or window sensor 120 is in the unlocked/unlatched condition, the system preferably prevents arming the system until the unlocked/unlatched condition(s) were corrected or they were specifically bypassed.

During initial setup of the LPPAM 101, all of the wireless window sensors 120 and the wireless door sensors 110 sensors within the LPPAM 101 are polled for storage of baseline keycode indentity values of the wireless window sensor 120 and the wireless door sensor 110 within the LPPAM 101. The baseline sensor values are constantly compared to polled sensor values from wireless window sensor 120 and the wireless door sensor 110 for a determination of a change in value indicating opening of a latch/lock mechanism and a possible intrusion. An alternative is placing scannable lables or an RFID tag on the wireless sensors to program the keycodes into the main control 140 to establish a protected net.

As discussed above, a single wireless window sensor 120, a single wireless door sensor 110, a single wireless interface extender 160, and a single user panel 150 are show in FIG. 1 for simplification of illustration only. During an implementation of the LPPAM 101, multiple addresses in the wireless interface extender 160 emulate, as well as differentiate zone types, such as a door open delay area vs. an instant alarm window opening detected.

The wireless window sensor 120 and the wireless door sensor 110 are capable of monitoring and reporting both an open/close condition and a locked/unlocked state of a window and door. In this manner a user could verify that all windows and doors within a premises are not only opened/closed, but also having the addition security of knowing whether all windows and doors within a premises are locked/unlocked.

Figure 2:
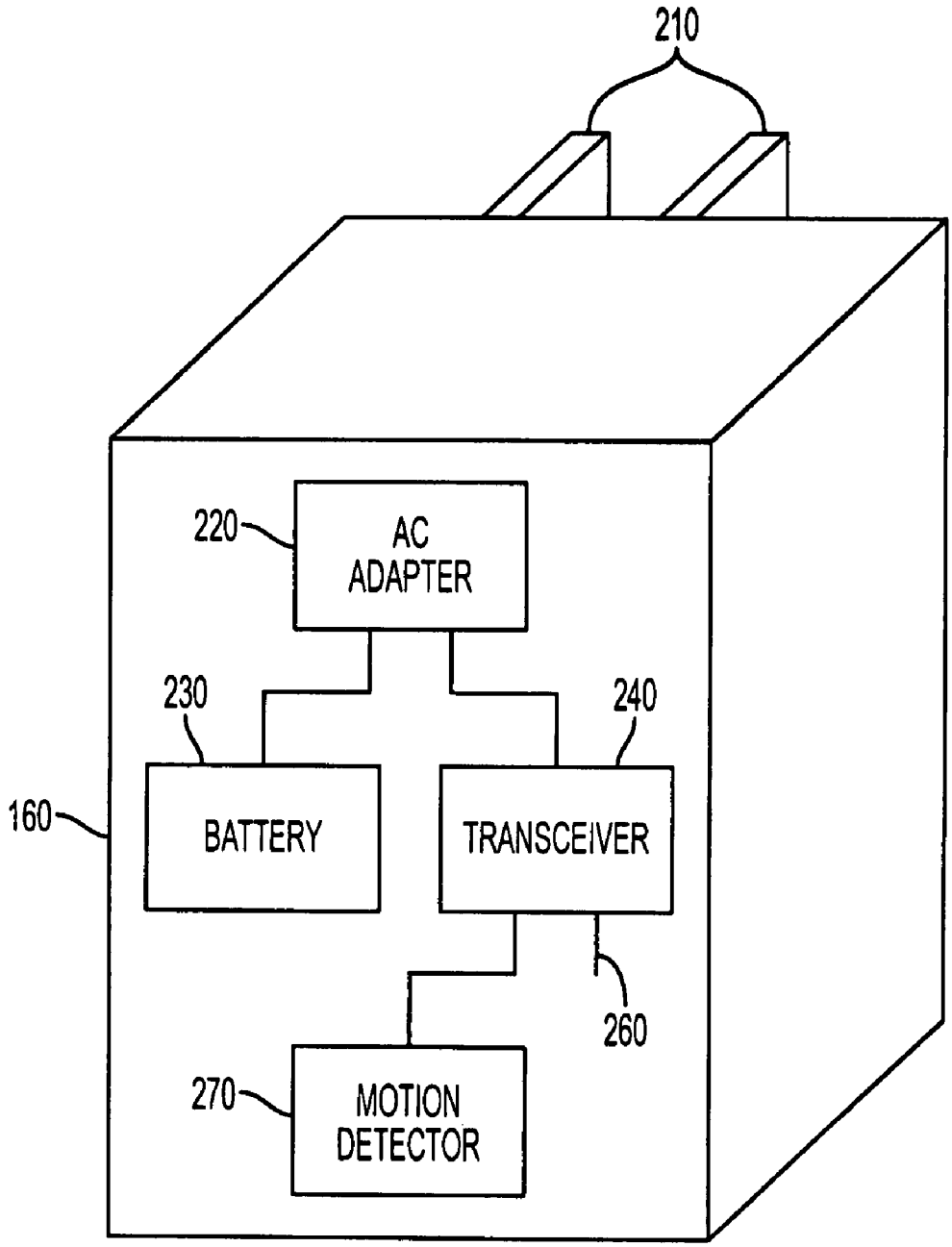
FIG. 2 shows a detailed view of the wireless interface extender from FIG. 1, in accordance with the principles of the present invention.

FIG. 2 shows a detailed view of the wireless interface extender 160 as shown in FIG. 1, in accordance with the principles of the present invention.

In particular, the wireless interface extender 160 is comprised of electrical outlet connectors 210, an AC adapter 220, a battery 230, a transceiver 240, and a transceiver antenna 260.

The electrical outlet connectors 210 allow the wireless interface extender 160 to receive power from the standard wall outlet 165 shown in FIG. 1.

Battery 230 allows the wireless interface extender 160 to perform its functions in the event that wireless interface extender 160 is unable to obtain power from a conventional wall outlet 165. Although not show in FIG. 2 for convenience, an AC power sensor is used to determine if the wireless interface extender 160 is obtaining power from the conventional wall outlet 165. If the AC power sensor determines that the wireless interface extender 160 is not obtaining power from the conventional wall outlet 165, a switch is triggered to allow the wireless interface extender 160 to be powered by battery 230.

The wireless interface extender 160 provides a communication link with main control panel 140, wireless window sensor 120 and the wireless door sensor 110. In this manner, wireless interface extender 160 acts as a extension bridge relaying sensor data from the wireless window sensor 120 and the wireless door sensor 110 to the main control panel 140 to allow a wireless window sensor 120 and a wireless door sensor 110 that cannot communicate directly with main control panel 140 a path to relay required sensor data to main panel 140.

Optionally, wireless interface extender 160 comprises motion detector 270. The motion detector 270 provides backup intrusion detection in the event that an intruder is able to gain access to a premises without opening window 125 and door 115, and/or in the event that the wireless window sensor 120 and the wireless door sensor 110 become inoperable. Other optional detectors that can be incorporated with the wireless interface extender 160 comprise a glass break detector, fire detector, infrared detector, carbon monoxide detector, etc.

The communications path between the wireless interface extender 160 and the main control panel 140 can utilize any wired or wireless technology, such as X10 power line communications, piconet (such as Bluetooth™), WiFi, HomePNA, Ethernet, etc. The system is optionally compatible with conventional wireless security systems at the interface of the transceiver 240 in the wireless interface extender 160.

Although the exemplary wireless interface extender 160 show in FIG. 1 is shown as being plugged into a conventional wall outlet 165 for power, for a more aesthetic installation the wireless local interface is incorporate into a wall power outlet, a powered smoke detector, a telephone line outlet, a motion detector, a glass break detector, a wall switch, etc., i.e., any other powered outlet that provides for improved installation aesthetics. From all appearances, the wireless local interface would therefore be indistinguishable from a conventional wall power outlet, smoke detector, a telephone line outlet, etc. This arrangement has the advantage of disguising the zones being covered by the LPPAM 101 from an intruder and at the same time freeing an outlet for conventional use of two plug-in devices for power and/or a plug-in for a telephone.

Moreover, wireless window sensor 120, wireless door sensor 110 and wireless interface extender 160 can form an ad hoc security network, such as a piconet (e.g., BLUETOOTH™), to extend the range of coverage of the main control panel 140. A security network can be formed from a plurality of wireless local interfaces for communication with a remote user panel, with the individual components relaying data to the main control panel 140.

Moreover, wireless window sensor 120, wireless door sensor 110, transceiver antenna 260 and an antenna within the main control panel 140 can be directional antennas for optimizing communications within the LPPAM 101. A directional antenna's orientation can be adjusted to maximize a communication signal's strength and associated distances between components within the LPPAM 101. In this manner, obstruction from such obstacles as other electronics, power lines, pipes, etc. can be minimized.

Figure 3:
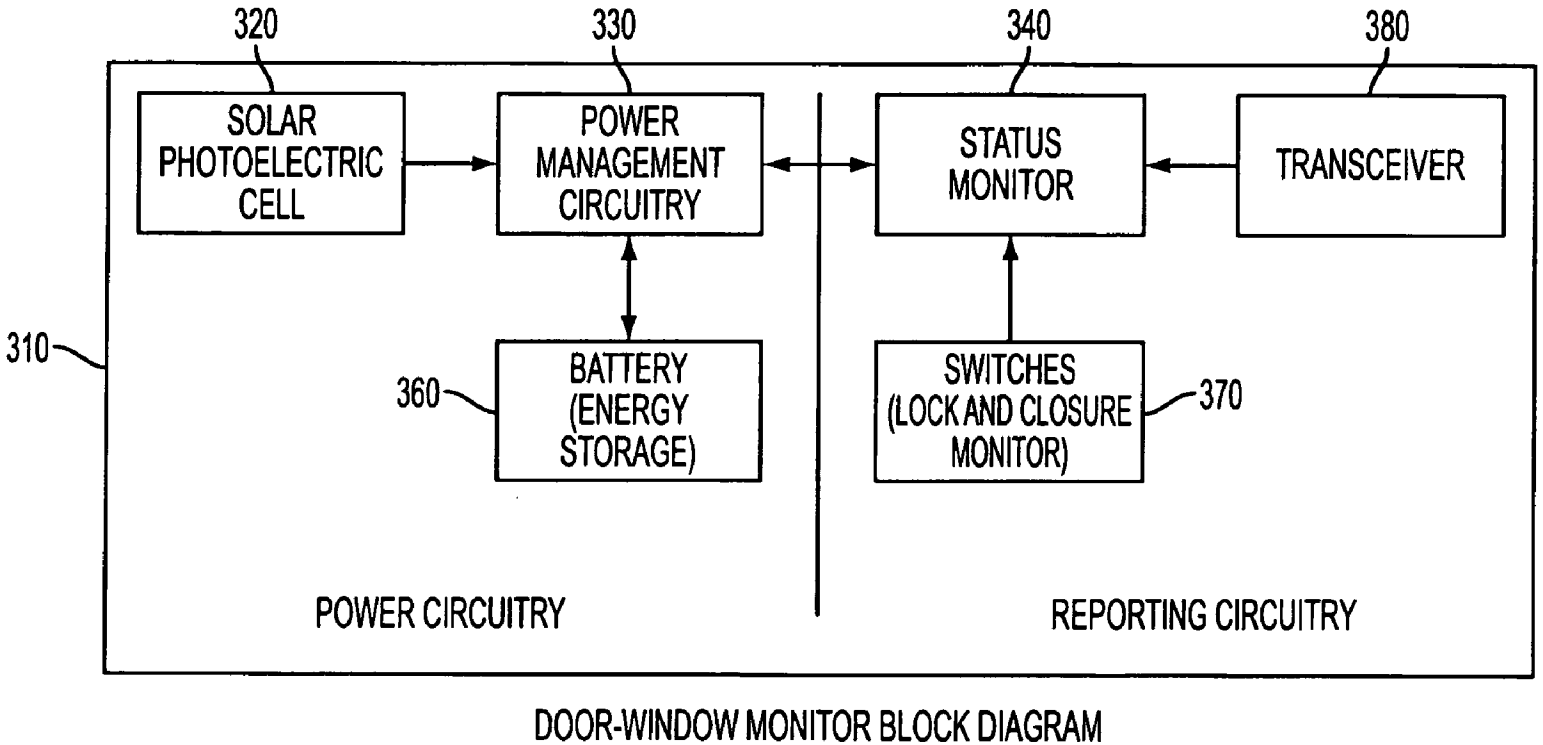
FIG. 3 shows a door-window monitor block diagram, in accordance with the principles of the present invention.

FIG. 3 shows a door-window monitor block diagram for a photoelectric cell powered wireless sensor 310 that comprises a wireless window sensor 120 and a wireless door sensor 110 as shown in FIG. 1, in accordance with the principles of the present invention.

In particular, the photoelectric cell powered wireless sensor 310 is shown for convenience as comprising two portions, i.e., a power circuitry portion and a reporting circuitry portion. The power circuitry portion of photoelectric cell powered wireless sensor 310 is comprised of a photoelectric cell 320, a power management circuitry 330 and a battery (energy source) 360. The reporting circuitry portion of photoelectric cell powered wireless sensor 310 is comprised of a status monitor 340, a switch (lock and closure monitor) 370, and a transceiver 380.

Photoelectric cell 320 collects light energy and transforms that energy into electrical energy that is used to power the photoelectric cell powered wireless sensor 310. The photoelectric cell is envisioned to be a thin film, quantum dot technology, or similar technology that has the characteristics of small size and low ambient light efficiency. This provides efficient energy conversion with minimal required thickness.

Power management circuitry 330 ensures that battery 360 is not overcharged to maximize the life of battery 360. Moreover, power management circuitry 330 performs power management functions to selectively activate status monitor 340 to conserve energy stored in battery 360. Power management circuitry 330 is optimally a simple CPU or state machine to minimize power draw for reporting LPPAM 101 status.

During sunny times of a day or when a local light is turn on, the photoelectric cell 320 is optimally outputting electrical energy to allow status monitor 340 to operate directly from power produced from photoelectric cell 320 to prevent draining battery 360, while still providing for battery charging. Intelligent power management maximizes power within battery 360 to allow status monitor 340 to operate during extended periods of total darkness, e.g., an interior room with no auxiliary lighting, or when photoelectric cell 320 is unable to collect enough photoelectric energy to charge battery 360 and power status monitor 340.

Energy source 360 can be also be a capacitor or small rechargeable based "infinite" number of cycles battery technology with minimal memory.

An alternative is to illuminate the photoelectric cell 320 with InfraRed energy to provide power to the device during periods of prolonged darkness. The InfraRed energy can be directed toward the photoelectric cell 320 to maximize charging of the energy source 360.

Although the photoelectric cell powered wireless sensor 310 is shown herein as comprising a transceiver 380, the transceiver 380 can be operated in a unidirectional mode to conserve power. Such a unidirectional mode would preferably be triggered by the power management circuitry 330 during periods of extended darkness, e.g., nighttime periods, to extend the life of the battery (energy source) 360.

Figure 4A:
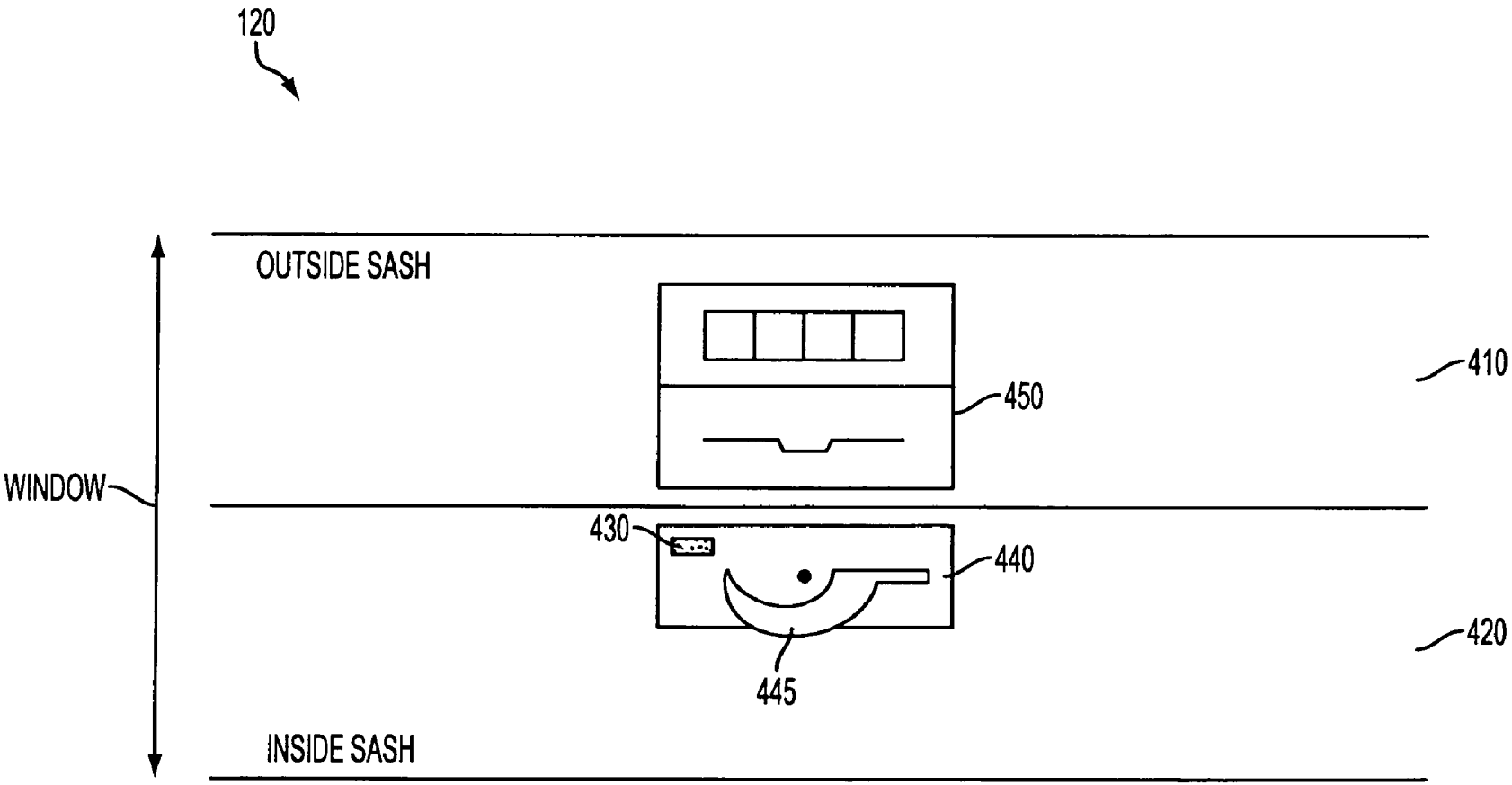
FIG. 4A shows a top view of a wireless window sensor, in accordance with the present invention.

FIG. 4A shows a top view of a wireless window sensor 120, in accordance with the present invention.

In particular, the wireless window sensor 120 is comprised of an inside sash portion 440 and an outside sash portion 450. As with a conventional window lock, wireless window sensor 120 relies on a pivoting arm 445 that rotates to couple the outside sash portion's 450 lock lip 452, shown in FIG. 4B, and the inside sash portion 440. Once coupled, the outside sash portion 450 and the inside sash portion 440 form a lock to prevent outside sash 410 and inside sash 420 from sliding apart as with a conventional window lock. However, to allow the outside sash portion 450 to determine if a window is in an open/close condition, an inside sash magnet 430 is used to trigger a magnetic switch 451 within the outside sash portion 450, show in FIG. 4B. Thus, the wireless window sensor 120 can determine if the inside sash portion 440 and the outside sash portion 450 have been opened/closed.

Figure 4B:
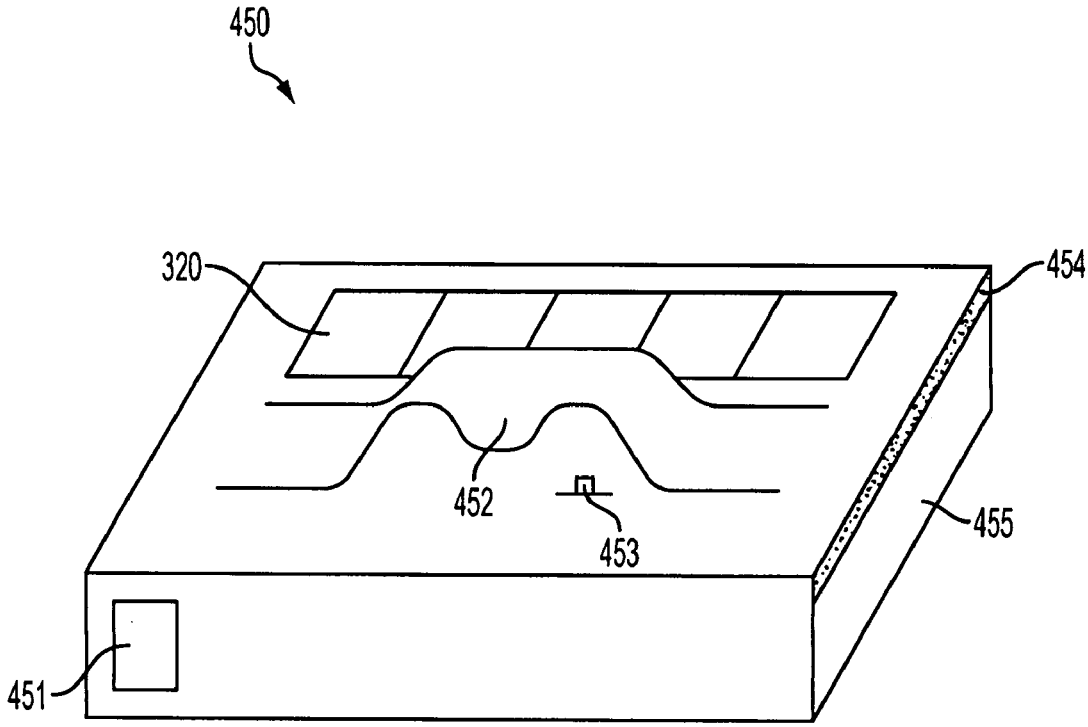
FIG. 4B shows a detailed view of the outside sash portion of the wireless window sensor from FIG. 4A, in accordance with the present invention.

FIG. 4B shows a detailed view of the outside sash portion 450 of the wireless window sensor 120 from FIG. 4A, in accordance with the present invention.

In particular, the outside sash portion 450 is comprised of a magnetic switch 451, a photoelectric cell 320, a locked/unlocked switch 453, and antenna 454, wireless window switch electronics 455, and lock lip 452.

The wireless window switch electronics 455 are show in detail in FIG. 3. As discussed above, the wireless window switch electronics 455 are comprised of a power circuitry portion and a reporting circuitry portion. The power circuitry portion is comprised of a photoelectric cell 320, a power management circuitry 330 and a battery (energy source) 360. The reporting circuitry portion of photoelectric cell powered wireless sensor 310 is comprised of a status monitor 340, a switch (lock and closure monitor) 370, and a transceiver 380.

The photoelectric cell 320 is shown as being positioned on the back top of the outside sash portion 450. The position of the photoelectric cell 320 is show by way of example, but can be positioned at any convenient position on the outside sash portion 450 that maximizes collection of light to maximize power generation.

An antenna 454 is show as being positioned on the right top side of the outside sash portion 450. The position of the antenna 454 is show by way of example, but can be positioned at any convenient position on the outside sash portion 450 that maximizes communications.

The magnetic switch 451 is triggered by the inside sash magnet 430 show in FIG. 4A. Once a window is opened/closed, the magnet switch is triggered to indicate that such an event has taken place.

The locked/unlocked switch 453 is provided to allow a user to further determine if a premises window is locked/unlocked. Thus, locked/unlocked switch 453 allows a user to prevent a window from being accidentally left unlocked after having opened it for whatever reason.

Although the features show in FIGS. 4A and 4B are show to exist on an inside sash and an outside sash, the features equally apply to swapping the outside sash portion 450 to be placed on an inside sash, and the inside sash portion 440 to be placed on an outside sash.

Although FIGS. 4A and 4B are shown by way of example for application to a wireless window sensor 120, the features shown in FIGS. 4A and 4B equally apply to a wireless door sensor 110.

Figure 5:
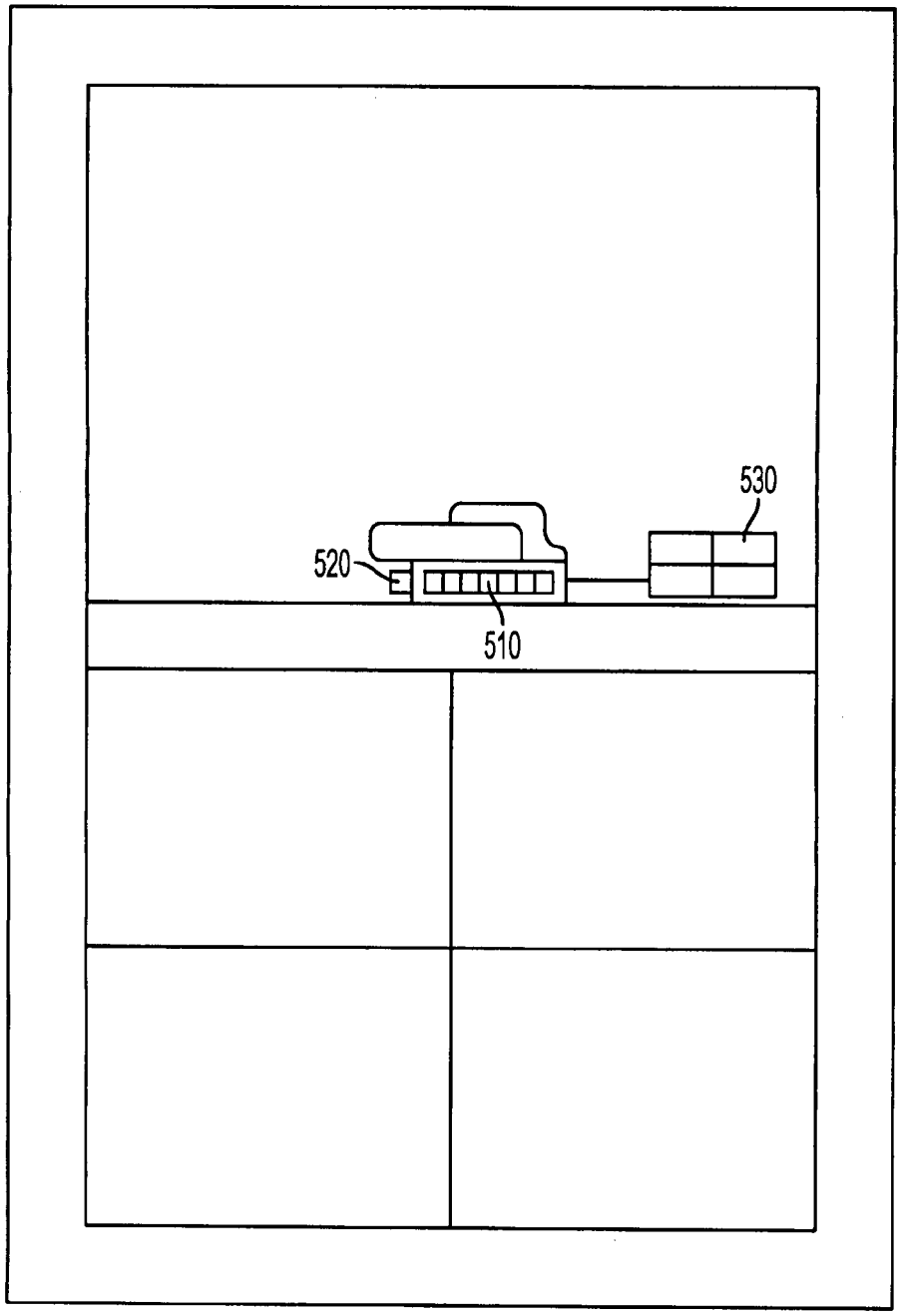
FIG. 5 shows an optional system for determining an optimal arrangement for a photoelectric cell, in accordance with the present invention.
Figure 6:
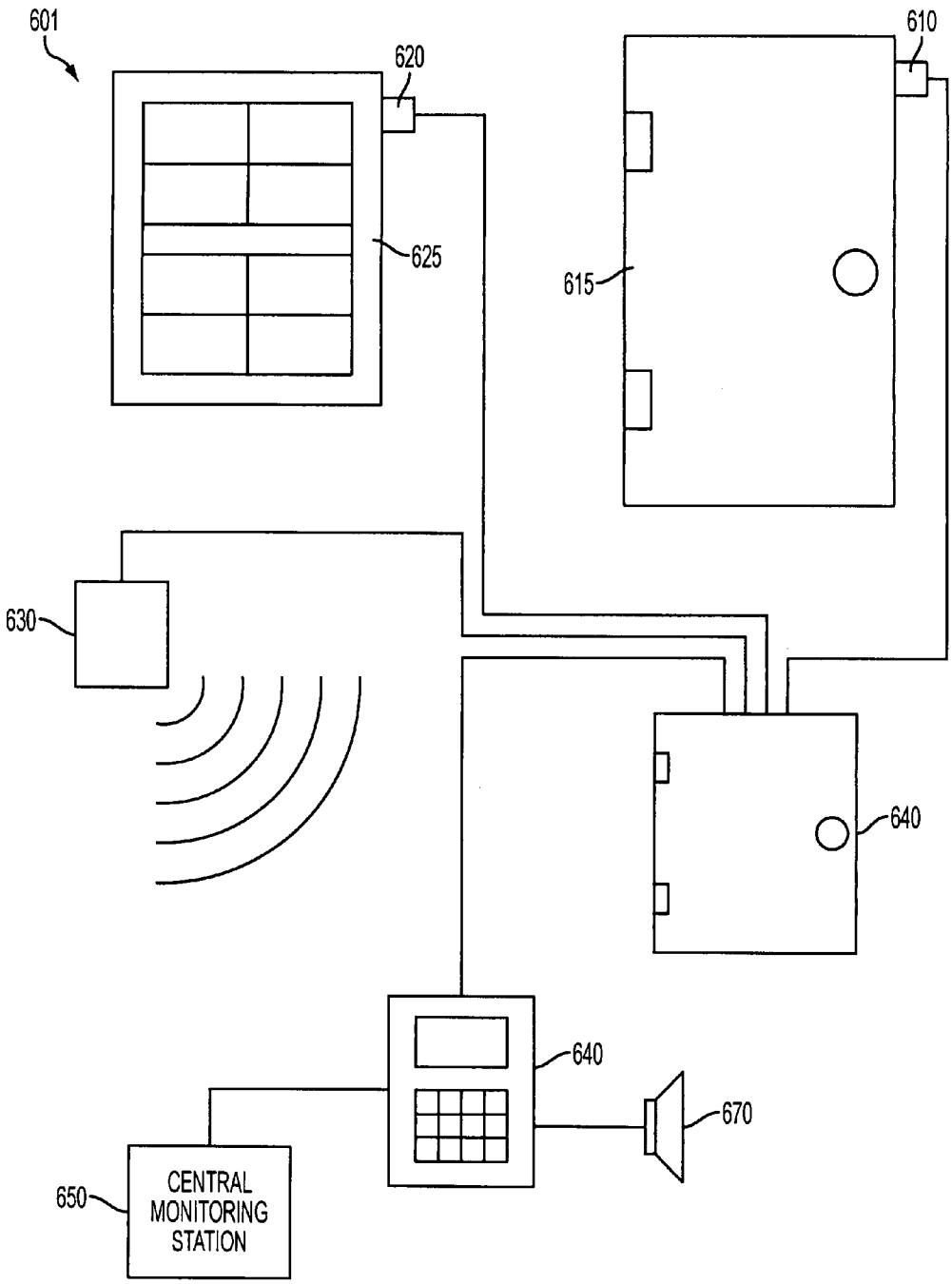
FIG. 6 PRIOR ART
FIG. 6 shows a conventional wired security system.
Figure 7:
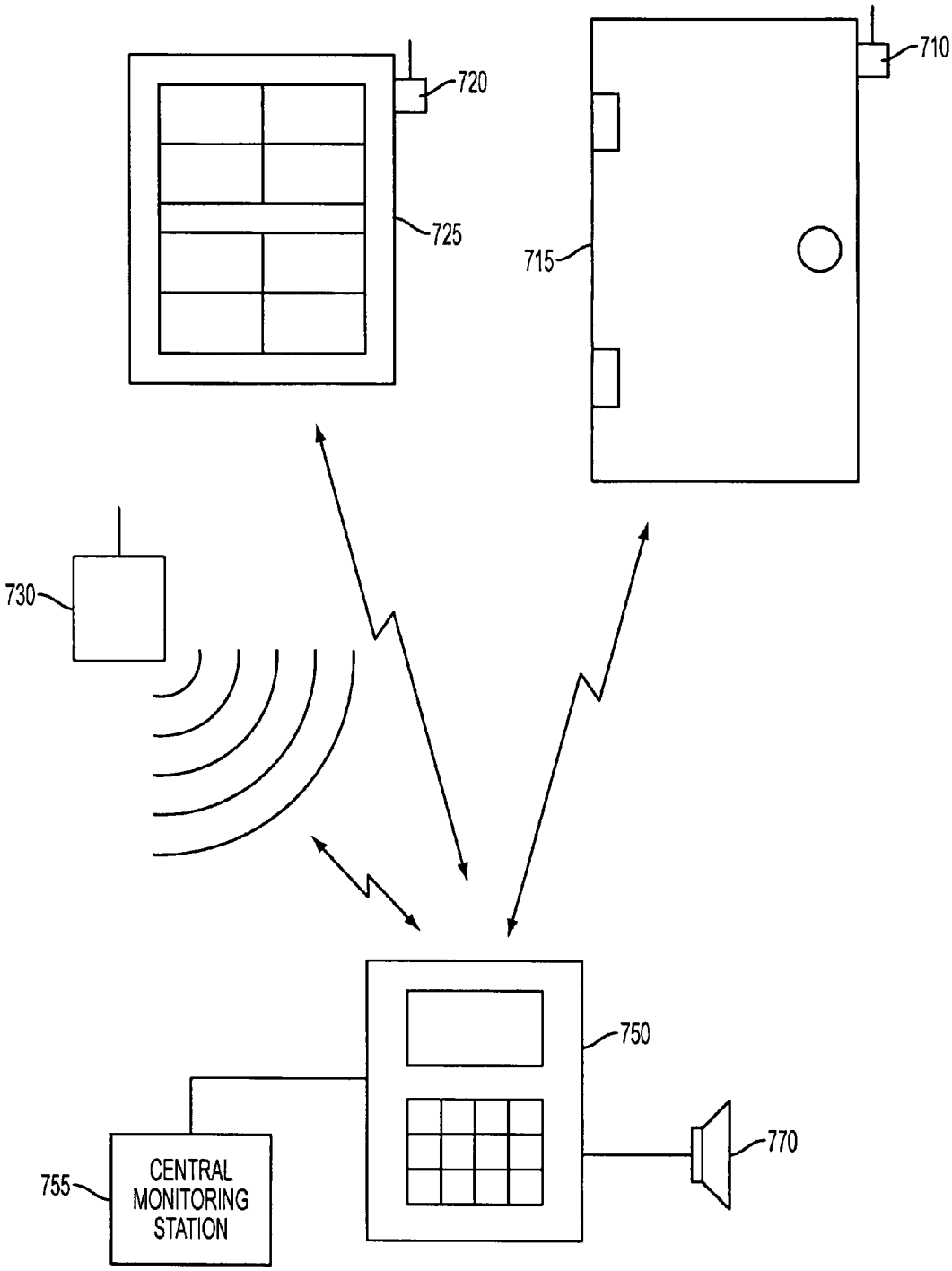
FIG. 7 PRIOR ART
FIG. 7 shows a conventional wireless security system.

Although most application would require a single, small module with the photoelectric cell on top as shown in FIGS. 4A and 4B, FIG. 5 shows an alternative optional system for determining an optimal arrangement for a photoelectric cell 320, in accordance with the present invention. Although a fixed location for a photoelectric cell 320 is possible, directing a photoelectric cell 320 toward an optimal direction to collect the greatest amount of photoelectric energy can be beneficial in certain applications. In low light applications, such as in a heavily treed area, a user would certainly desire to optimally direct photoelectric cell 320 toward a particular direction possibly where light energy is available for a greater portion of a 24 hour day. To direct photoelectric cell 320 toward a particular direction, photoelectric cell 320 would be pivotally positioned on a wireless window sensor 120, a wireless door sensor 110 and/or an optional external photoelectric cell 530.

In particular, wireless window sensor 120 further comprises a test button 520, a Liquid Crystal Display (LCD) meter 510, and an optional external photoelectric cell 530.

A user with the desire to optimally position photoelectric cell 320 or optional external photoelectric cell 530 would depress test button 520 to activate LCD meter 510. Depressing test button 520 would preferably cause all power from photoelectric cell 320 or optional external photoelectric cell 530 to be directed toward LCD meter 510. A user would then adjust the orientation of photoelectric cell 320 or adjust the orientation and placement of optional external photoelectric cell 530 while pressing test button 520 to obtain a visual indication of the amount of energy being produce by photoelectric cell 320 or optional external photoelectric cell 530. Testing of the wireless window sensor can be performed at a time of day that is representative of when the sun's strength is the greatest, such as approximately noon, to determine an optimal arrangement when battery 360 charging is at its greatest potential.

While the invention has been shown and described with reference to the provision of a security system relying on photoelectric technology, the principles disclosed herein relate equally to use of any power source that does not rely on a battery that requires periodic replacement.

While the invention has been shown and described with reference to a security system incorporating the novel features described herein, a conventional wired and conventional wireless security system can be retrofitted with the components described. Retrofitting a conventional wired and conventional wireless security system eliminates some of the costs associated with having to buy a new main control panel, remote user panel and speaker. An emulation security module would emulate components within a conventional wired and conventional wireless security system to allow existing components to communicate within the novel components described herein.

While the invention has been shown with a motion detector within wireless interface extender 160, an additional motion detector can be incorporated anywhere within the system to generate an alert if motion is detected within the vicinity of the motion detector.

As the present invention is directed toward a security system, encryption would preferably be used with all communications disclosed herein to prevent interception of security messages flowing within the system and disablement of the security system.

While the invention has been described with reference to the exemplary embodiments thereof, those skilled in the art will be able to make various modifications to the described embodiments of the invention without departing from the true spirit and scope of the invention.

What is claimed is:

1. A wireless security sensor, comprising:

a security switch;

a first wireless transmitter to wirelessly transmit security sensor data associated with said security switch to a local main control unit; and a Radio Frequency Identification (RFID) tag comprised of a second wireless transmitter to program said local main control unit with a keycode for said wireless security sensor, said RFID tag's second wireless transmitter being distinct from said first wireless transmitter transmitting said security sensor data from said wireless security sensor.

2. The wireless security sensor according to claim 1, further comprising:

a scannable label to program said local main control unit with a keycode for said security sensor.

3. The wireless security sensor according to claim 1, wherein:

said second wireless transmitter operates in a unidirectional mode to conserve power.

4. The wireless security sensor according to claim 1, further comprising:

a photoelectric cell manually adjustable toward a light source.

5. The wireless security sensor according to claim 1, wherein:

said security sensor is integrated with a window lock.

6. The wireless security sensor according to claim 4, further comprising:

an energy storage device to store energy produced by said photoelectric cell.

7. The wireless security sensor according to claim 1, wherein:

said second wireless transmitter is a Bluetooth™ transmitter.

8. The wireless security sensor according to claim 1, wherein:

said second wireless transmitter transmits to a wireless interface extender.

9. The wireless security sensor according to claim 8, wherein:

said wireless interface extender is integrated with any of a wall power outlet, a telephone line outlet, a smoke detector, a motion detector, a glass break detector and wall switch.

10. The wireless security sensor according to claim 5, wherein:

said security sensor is integrated with said window lock at a time of manufacture of said window lock.

11. The wireless security sensor according to claim 1, wherein:

said security sensor is integrated with a door lock.

12. The wireless security sensor according to claim 11, wherein:

said security sensor is integrated with said door lock at a time of manufacture of said door lock.

13. The wireless security sensor according to claim 8, wherein:

said wireless interface extender comprises a motion detector.

14. The wireless security sensor according to claim 1, wherein:

said security sensor data is an open/close condition.

15. The wireless security sensor according to claim 1, wherein:

said security sensor data is a lock/unlocked condition.

16. A security method, comprising:

formulating security sensor data;

transmitting, with a first wireless transmitter, said security sensor data to a local main control unit; and programming said local main control unit with a keycode obtained from a Radio Frequency Identification (RFID) tag comprised of a second wireless transmitter and associated with a wireless security sensor, said RFID tag's second wireless transmitter being distinct from said first wireless transmitter transmitting said security sensor data from said wireless security sensor.

17. The security method according to claim 16, further comprising:

programming said main control unit with a keycode obtained from a scannable label associated with said first wireless security sensor.

18. The security method according to claim 16, wherein:

said transmitting is performed in a unidirectional mode to conserve power.

19. The security method according to claim 16, wherein:

said transmitting is performed with a Bluetooth™ transmitter.

20. The security method according to claim 16, further comprising:

transmitting an open/close condition.

21. Apparatus for security, comprising:

means for formulating security sensor data;

means for transmitting, with a first wireless transmitter, said security sensor data to a local main control unit; and means for programming said local main control unit with a keycode obtained from a Radio Frequency Identification (RFID) tag comprised of a second wireless transmitter and associated with a wireless security sensor, said RFID tag's second wireless transmitter being distinct from said first wireless transmitter transmitting said security sensor data from said wireless security sensor.

22. The apparatus for security according to claim 21, further comprising:

means for determining an open/close condition.

23. The apparatus for security according to claim 21, further comprising:

means for determining a lock/unlocked condition.

* * * * *